United States Patent [19]

Furutu

[11] 4,347,932

[45] Sep. 7, 1982

[54] TAG PIN

[75] Inventor: Akira Furutu, Tokyo, Japan

[73] Assignees: Clements Industries, Inc., South Hackensack, N.J.; Japan Bano'k Co. Ltd., Tokyo, Japan

[21] Appl. No.: 87,848

[22] Filed: Oct. 24, 1979

Related U.S. Application Data

[63] Continuation of Ser. No. 845,961, Oct. 27, 1977, abandoned, which is a continuation of Ser. No. 727,234, Sep. 27, 1976, abandoned.

[51] Int. Cl.[3] ..... A44B 9/00; B44D 3/18

[52] U.S. Cl. ..... 206/343; 24/72.7; 24/150 FP; 24/201 A; 206/820

[58] Field of Search ..... 24/150 FP, 72.7, 102 A, 24/201 A; 40/20 R; 206/343, 338, 820, 346

[56] References Cited

U.S. PATENT DOCUMENTS

| | | | |
|---|---|---|---|
| 3,444,597 | 5/1969 | Bone | 24/150 FP |
| 3,733,657 | 5/1973 | Lankton | 206/343 |
| 3,765,110 | 10/1973 | Olsen | 40/20 R |
| 3;850,297 | 11/1974 | Merser | 24/150 R |
| 3,977,050 | 8/1976 | Perez | 24/150 FP |

FOREIGN PATENT DOCUMENTS

| | | | |
|---|---|---|---|
| 950402 | 2/1964 | United Kingdom | 40/21 R |

*Primary Examiner*—Alexander Grosz

*Attorney, Agent, or Firm*—Blum, Kaplan, Friedman, Silberman & Beran

[57] ABSTRACT

The present invention involves a tag pin group comprised of single unit tag pins each of which has a transverse bar portion, a filament portion extending perpendicular to the transverse bar portion and a connecting portion to connect the transverse bar portion to a connecting bar on which each of the tag pin units is contained and where each tag pin has a head portion connected at one end of the filament such that at least one edge portion of the head portion slopes away from the transverse bar portion from the point where the head portion is connected to the filament.

7 Claims, 20 Drawing Figures

TAG PIN

This is a continuation of application Ser. No. 845,961, filed Oct. 27, 1977, now abandoned, which is a continuation of Ser. No. 727,234, filed on Sept. 27, 1976, now abandoned.

OUTLINE OF THE INVENTION

The present invention relates to a tag pin which causes little intertwining and entangling.

There have been known tag pins in which a head portion, a filament portion extending laterally from the center portion of said head portion and a transverse bar portion fixed to the filament portion at its center portion are integrally molded from a synthetic resin (for example, shown in U.S. Pat. No. 3,103,666).

Such tag pins are molded as a large group in an arrangement where one end thereof is fixed to a connecting bar, so that, particularly the head portions thereof are easily tangled, and accordingly the handling of the tag pins at the time of packing them in a box or taking them out of a box is very difficult.

The present invention prevents entangling of the head portions without the need of an interconnection between the adjacent head portions such as a connecting string and is characterized in that the edge portion of the head portion opposite to the transverse bar portion is formed so as to gradually spread out laterally from the center of the head portion in a funnel shape.

According to the present invention, since the edge of the head portion opposite the transverse portion is spread out like funnel shape, when the head portions intertwine with each other, it is possible to release the intertwining of the head portions by pulling the tag pin groups from each other two or three times, thereby allowing the head portions to slip along the edge portions which act as guide faces. Also, the head portion of the tag pin of the present invention has no projection thereon which may hook the texture of knittings or fabrics, so that there is no possibility that various kinds of articles will get scratched.

BACKGROUND OF THE INVENTION

The present invention relates to a synthetic resin tag pin used for attaching a price tag or other indication tag (label for article) to an article or for interconnecting two or more articles together.

A tag pin using a synthetic resin, particularly nylon, with the filament portion and the head portion integrally molded into an H-shape as a whole, has already been proposed, for example, by U.S. Pat. No. 3,103,666.

This prior art tag pin has a superior function such that it can attach a price tag or the like to an article such as cloth, etc. by using an attaching device in a single and simple operation. The size of this tag pin is such that in the case of a standard one, the thickness of the transverse bar portion is 1.0 mm, the length thereof is 9.0 mm, the length of the filament portion 15.0–60.0 mm, the thickness thereof at the stretched portion 0.5 mm, the lateral size of the head portion 9.0 mm and the longitudinal size thereof at the center portion about 4.0–6.0 mm.

As a shape for the head portion, there have been known those such as a rectangular one shown in FIG. 1(A) and another one having a mountain-shaped upper side as shown in FIG. 1(B). In any case, the edge portion M of the head portion opposite to the transverse bar portion is formed parallel to the transverse bar portion.

This kind of tag pin is very small in its size as exemplified above, and its weight per unit amounts to about 0.8–2.0 g. Moreover, since there is a problem in the individual production of the tag pins from the viewpoint of production and handling thereof, in practice a plurality of tag pins (for example 20–50 pieces) are molded integrally in a lump as shown in FIG. 2. Explaining completely with reference to FIG. 2, a tag pin A is composed of a transverse bar portion 1, a filament portion 2 and a head portion 3, and a connecting portion 4 extended in the opposite direction to the attaching portion of the filament 2 to the transverse bar portion 1, and said connecting portion is connected to a connecting bar 5 which serves also as a pouring hole (runner) for molten resin, and thus a plurality of tag pins are assembled like a comb. In the case where the length of the filament potions 2 in a tag pin group is relatively short, the portion of the head portions 3 are generally held in place. However, with an increasing length in the filament portions 2, the flexibility of these portions increases, so that the head portions 3 becomes easy to displace, thereby resulting in an occurrence of entangling of the filament portions 2. In the case where the tag pins are made of nylon resin, they have a relatively good shape holding property immediately after the molding thereof, but nylon causes moisture absorption as time goes by, and consequently the filament portions become gradually soft and thereby tag pin groups become easily entangled with each other, particularly in the case where the head portions intertwine as shown in FIG. 3. It is very troublesome to release these groups from each other, once they are entangled.

In the packing process of the tag pins after the molding thereof, it is normal to accommodate about 5,000 to 10,000 tag pins in one box, and in the course of transportation if necessary, or at the time of use, a number of tag pins are taken out of the box together and then the remaining ones are returned to the box. However, in such cases, the tag pin groups often become entangled as shown in FIG. 3. Consequently, a method of integrally molding a tag pin group with their adjacent heads interconnected by means of a thin string in skewered condition has been proposed (for example, U.S. Pat. No. 3,733,657). However, the tag pin groups molded by said method are difficult to separate into individual units from the group at the time of use thereof, and since said connecting string must be pulled off, the connecting string may be left on the side of the head portion as projection. Also this tip portion of said projection may be subjected to stretching thereby leaving it in a pointed condition, so that the pointed projection may snag delicate knittings or fabrics and this results in damage thereto.

As is well known in the art, molding of a delicate thin connecting string is very difficult, and from the viewpoint of technique, the limit of molding thereof is in a range of 0.1 to 0.15 mm in diameter. Also, if this connecting string is easy to cut off, it may often accidently cut off during the transportation or handling thereof, and when a part of the connecting string be cut off, the handling of the tag pins becomes more troublesome than ever. In order to mold this connecting string, delicate workings on a metal mold are required, so that the metal mold per se becomes expensive. Also, excessive management of the metal mold and delicate working thereon may be necessary, and thus its service life becomes short.

SUMMARY OF THE INVENTION

The present invention has as an object the removal of the above described drawbacks of the prior art and is characterized in that, in a tag pin group, without connecting string for interconnecting the head portions thereof, the edge of a head portion opposite to a transverse bar portion of each tag pin has a funnel-like shape in which as the center portion of the edge approaches the transverse bar portion and as the edge approaches, both sides of the head portion it gradually slopes away from the transverse bar.

BRIEF DESCRIPTION OF THE DRAWINGS

FIGS. 8(A) and 8(B) to 10(A) and 10(B) are front views and side views respectively showing various head portions of the present invention.

DETAILED DESCRIPTION OF THE EMBODIMENTS

The invention will be described in detail hereinafter with reference to the drawings.

Figure 4:
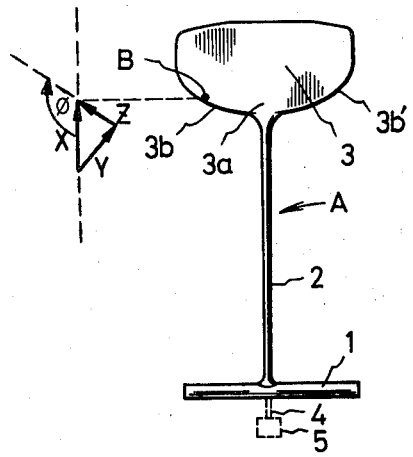
FIGS. 4 to 6 are front views showing various tag pins of the present invention respectively.

FIG. 4 is a front view showing a first embodiment of the present invention, wherein a tag pin A is integrally molded from a synthetic resin having elasticity, such as nylon into an H-shape and which comprises a head portion 3, a filament portion 2 and a transverse bar portion 1. Of course, at the time of molding the tag pins, a plurality of tag pins (for example thirty-five to fifty units) are connected to a connecting bar 5 via connecting portions 4 to form an integral group. Immediately after the molding, the filament portion 2 is not very high in strength, so that it is easy to bend and has insufficient strength to be restored to its original shape after being passed through an article by means of an attaching device. Accordingly, the filament portions are subject to a stretching treatment to improve their strength. There are two methods involved in the stretching treatment. One is a method using a metal mold itself for the stretching operation, and the other is a method wherein stretching is carried out in a separate stretching machine after the molding has been completed.

Figure 1A:
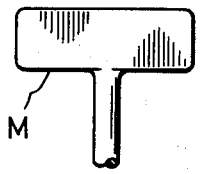
Fig. 1(A) PRIOR ART
FIG. 1(A) and FIG. 1(B) are front views showing the head portions of prior art tag pins respectively.
Figure 1B:
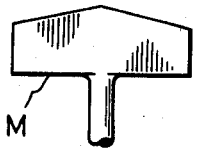
Fig. 1(B) PRIOR ART
Figure 2:
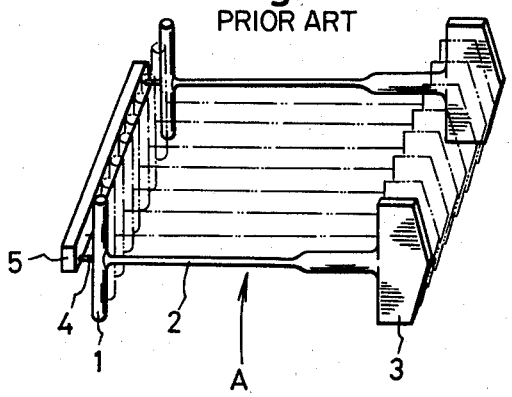
Fig. 2 PRIOR ART
FIG. 2 is a perspective view of a tag pin group.
Figure 3:
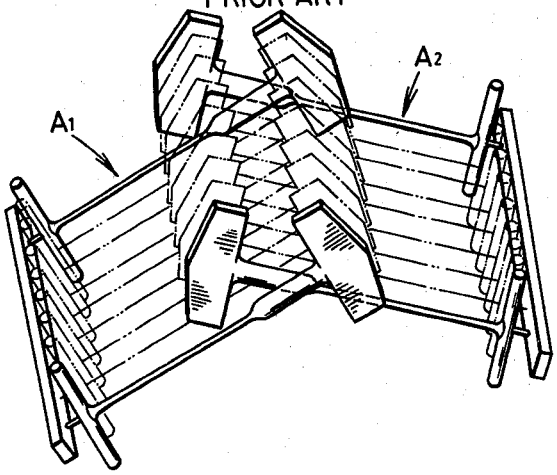
Fig. 3 PRIOR ART
FIG. 3 is a perspective view showing an intertwined condition of the head portions and the filament portions of prior art tag pin groups.

The filament portion 2 extends from the center portion 3*a* of the head portion 3, and the edge portions 3*b* and 3*b'* of the head portion 3 slopingly spread out from said center portion 3*a* toward both sides of the head portion 3 in a funnel shape. In the embodiment shown in FIG. 4, the edge portions 3*b* and 3*b'* are formed in a curved shape, so that when a force X from the direction of the arrow is applied, for example, at the point B, its component forces Y and Z occur and owing to this component force Z the head portion of another tag pin can be slipped out of entanglement with this head portion. Particularly, in the case where the head portions are engaged with each other as shown in FIG. 3, said component force Z may be applied to the head portions mutually, so that disengagement of those head portions becomes easy.

Figure 5:
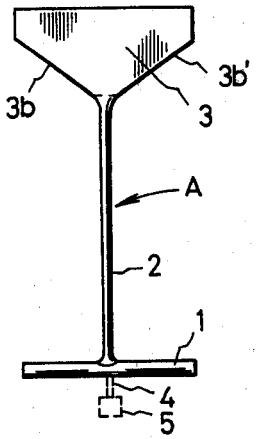

FIG. 5 shows a second embodiment which has a head portion of an inverted and modified triangle shape with the edge portions 3*b* and 3*b'* slopingly spread out to a point.

Figure 6:
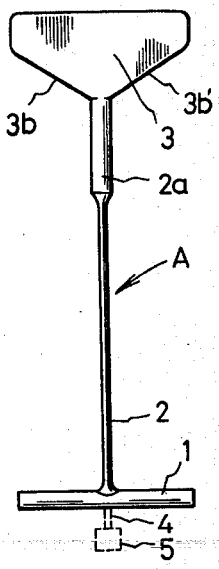
Figure 7A:
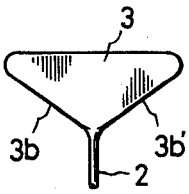
FIGS. 7(A) to 7(G) are front views showing various shapes of the head portions of tag pins of the present invention respectively.
Figure 7B:
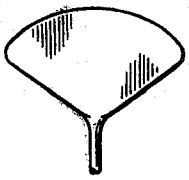
Figure 7C:
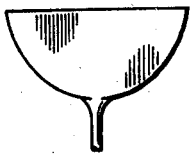
Figure 7D:
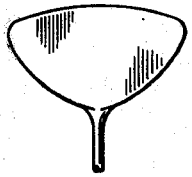
Figure 7E:
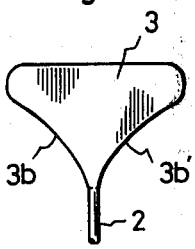
Figure 7F:
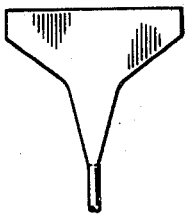
Figure 7G:
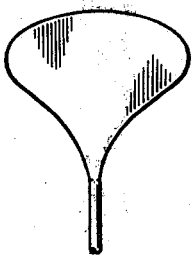

FIG. 6 shows another embodiment which has rounded corners on the head portion 3 and a neck part 2*a* of the filament portion 2 connected with the head portion 3 being left unstretched. Otherwise it is similar to that shown in FIG. 5.

FIGS. 7(A) to 7(G) show further embodiments, wherein 7(A) illustrates an inverted triangle shape, 7(B) an unfolded fan shape, 7(C) a semicircular shape, 7(D) a Braun tube shape, and 7(E) to 7(G) illustrates shapes in which the edge portions 3*b*, 3*b'* are narrowed toward the center line of the filament portion respectively.

In the embodiments shown in FIGS. 7(A) to 7(G), the head portions are shown as having flat surfaces thereon, however various kinds of projections can be provided on the surfaces of the head portions according to the use thereof.

Figure 8A:
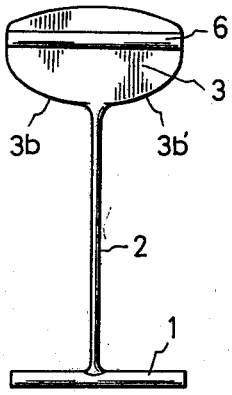
Figure 8B:
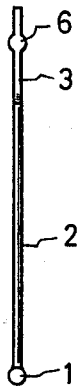

FIGS. 8(A) and 8(B) show an embodiment having a very thin head portion which is formed with a transverse bar-like projection 6 thereon to prevent deformation of the head portion.

Figure 9A:
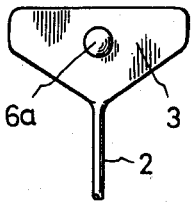
Figure 9B:
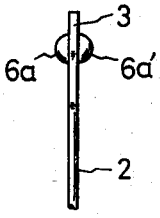

FIGS. 9(A) and 9(B) show a head portion 3 having hemispherical projections 6*a* and 6*a'* on both sides thereof. These projections act to positively provide a space between adjacent head portions so as to reduce entangling thereof and allow easy release of entangled head portions.

Figure 10A:
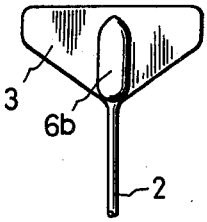
Figure 10B:
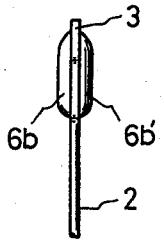

FIGS. 10(A) and 10(B) show an embodiment having a head portion formed with ship bottom-like projections 6*b* and 6*b'* on the extension line of the filament portion 2, so that these projections act to maintain a space between the head portions and thereby reduce the resistance occurring at the time of release of the head portions from each other to as small an amount as possible.

According to the present invention, various kinds of head portions as shown in FIGS. 4 to 10(B) may be provided, but the important point is to determine the shape of the edge portions 3*b* and 3*b'* of the head portion 3 such that when another head portion is entangled with the edge portions 3*b* and 3*b'*, a component force of the direction Z of the vector diagram shown in FIG. 4 is produced. This shape is preferably of a funnel or morning-glory shape on the whole. In order to provide a components force in the direction of vectors Y and Z, a tangent at each point B along edge portions 3*b* and 3*b'* must form an obtuse angle $\theta$ with filament 2 as shown in FIG. 4. So long as angle $\theta$ is greater than 90° there is a vector in the direction of force Z when a force X from the direction of the arrow is applied. In this case the curved shape of edge portions 3*b* and 3*b'* form a convex release means facing transverse bar portion 1 thereby facilitating removal of a single tag pin from an assembly of tag pins or removal of an assembly of tag pins from an intermixed group of assemblies of tag pins.

FIG. 3 shows a condition such that tag pin groups $A_1$ and $A_2$ of the prior art are intertwined with each other, resulting in it being difficult to disengage them. However, in the case where the tag pin groups of the present invention are under such condition, these groups $A_1$ and $A_2$ are easily released from each other by lightly pulling them by holding the connecting bars 5 thereof or by moving them back and forth two or three times so as to cause them to approach and separate from each other.

As noted above, the present invention is characterized in that the edge portions 3b and 3b' of the head portion 3 opposite to the transverse bar portion 1 are formed so as to slope away from said transverse bar portion 1 as it spreads out from the center of the head portion 3, and as a result of such formation of the edge portion, it is possible to easily disengage a plurality of tag pin groups into separate groups only by applying a light pulling force thereto in the case where they are intertwined with each other.

Consequently, according to the present invention, it is unnecessary to adopt means for interconnecting the head portions by use of a connecting string, etc., so that products of inferior quality are not produced in the molding process of the tag pins, and the metal mold can be simplified. In addition, since the head portion has no connecting string on both side faces thereof, the attaching operation of the tag pin can be carried out easily, and there is no possibility to give damage to delicate knittings or fabrics by snagging the connecting string thereto, because any connecting string is not left on the surface of the head portion as a projection.

What is claimed is:

1. A tag pin group comprised of a plurality of integrally molded tag pins formed from a synthetic resin and lying in an aligned row, each said tag pin comprising:

a solid head portion, said head portion including a transverse bar-like projection, said transverse bar-like projection being positioned approximately mid-way of the longitudinal height of said head portion and coinciding with the largest head width, thereby assuring that the head portion maintains its maximum width, and permitting the use of a relatively thin head portion while preventing deformation of the head portion;

an elongate transverse bar portion having a uniform cross-section;

a filament portion interconnecting said head and transverse bar portions to form a tag pin having a generally H-shape;

a connecting portion extending from said transverse bar portion in a direction away from said filament portion;

a connecting bar connecting each of said connecting portions of said tag pins, wherein said connecting portion and said connecting bar cooperate to form said tag pin group, said head portion and said transverse bar portion of each tag pin being substantially coplanar and the head and transverse bar portion of each tag pin of said tag pin group lying in substantially parallel planes; and said solid head portion further including an edge opposite said transverse bar portion, said edge being formed so as to continuously arcuately slope away from said transverse bar portion as it spreads out from the center of the head portion to its outer periphery, the arcuately sloped edge portion forming an obtuse angle with said filament, thus forming a convex release means facing said transverse bar portion permitting easy removal of a single tag pin or group of tag pins from an intermixed group of tag pins.

2. The tag pin group of claim 1 wherein the bar-like projection of each tag pin of said tag pin group is substantially aligned with the bar-like projection of adjacent tag pins thereby assuring a space between adjacent tag pin solid head portions in the tag pin group.

3. The tag pin of claim 1, wherein said edge opposite said transverse bar portion is formed by two curved lines which gradually reduce the distance therebetween while approaching the intersection of said filament portion with said head portion.

4. The tag pin of claim 1, wherein said head and transverse bar portions are substantially more rigid than said filament portion.

5. An assembly of tag pins comprising a plurality of integrally molded tag pins formed from a synthetic resin and lying in an aligned row, each of said tag pins including a solid head portion, an elongate transverse bar portion having a uniform cross-section, and a filament portion interconnecting said head and transverse bar portions to form a tag pin having a generally H-shape;

a connecting portion extending from the transverse bar portion of each of said tag pins in a direction away from the filament portion thereof;

and a connecting bar connecting each of said connecting portions, wherein said connecting portions and said connecting bar cooperate to form said assembly, said head portion and said transverse bar portion of each tag pin being substantially coplanar and the head and transverse bar portions of each tag pin of said assembly lying in substantially parallel planes;

said head portion being free of attachment to an adjacent head portion and further including an edge opposite said transverse bar portion, said edge being formed to slope away continuously from said transverse bar portion as it spreads out from the center of the head portion to its outer periphery, the sloped edge portion forming an obtuse angle with said filament for forming a release means facing said transverse bar portion permitting easy removal of a single tag pin from the assembly and removal of an assembly of tag pins from an intermixed group of assemblies of tag pins.

6. The assembly of claim 5, wherein said slope of said edge of said head portion is a continuously arcuate slope.

7. The assembly of claims 1, 5 or 6, wherein said filament is flexible.

* * * * *